US005341788A

United States Patent [19]

Uchida

[11] Patent Number: 5,341,788

[45] Date of Patent: Aug. 30, 1994

[54] AIR-FUEL RATIO CONTROLLER FOR MULTIPLE CYLINDER BANK ENGINE

[75] Inventor: Masaaki Uchida, Yokosuka, Japan

[73] Assignee: Nissan Motor Co., Ltd., Yokohama, Japan

[21] Appl. No.: 33,888

[22] Filed: Mar. 18, 1993

[30] Foreign Application Priority Data

Mar. 24, 1992 [JP] Japan ..... 4-066306

[51] Int. Cl.[5] ..... F02D 41/14

[52] U.S. Cl. ..... 123/692

[58] Field of Search ..... 123/691, 692

[56] References Cited

U.S. PATENT DOCUMENTS 4,976,242 12/1990 Sonoda et al. ..... 123/682

5,265,581 11/1993 Nagaishi ..... 123/675

FOREIGN PATENT DOCUMENTS 62-63156 3/1987 Japan .

*Primary Examiner*—Tony M. Argenbright

*Attorney, Agent, or Firm*—Foley & Lardner

[57] ABSTRACT

This invention relates to an engine provided with a plurality of cylinder banks, exhaust manifolds for collecting exhaust from each bank, an exhaust branch pipe for combining the flows from the exhaust manifolds, and a three-way catalyst interposed in the exhaust branch pipe. An air-fuel ratio sensor is interposed in the exhaust manifold for each cylinder bank, and feedback control of the air-fuel ratio of each bank is performed based on the air-fuel ratio detected by the sensor of a specific bank such that this air-fuel ratio varies with a predetermined amplitude about the theoretical value as center value. The rich and lean times of the air-fuel ratio of the other banks are also measured from the output of the sensor at each bank, and feedback control is corrected for each bank such that the rich time is equal to the lean time for any bank. The number of sensors required for air-fuel ratio control of a multi-bank engine can therefore be reduced, and as the air-fuel ratio detected at the location of the three-way catalyst varies within a suitable range of tolerance, the exhaust cleaning performance of the three-way catalyst is improved.

4 Claims, 8 Drawing Sheets

AIR-FUEL RATIO CONTROLLER FOR MULTIPLE CYLINDER BANK ENGINE

FIELD OF THE INVENTION

This invention relates to an air-fuel ratio controller used in an engine provided with a multiple cylinder bank such as a V-type engine or horizontal opposed engine.

BACKGROUND OF THE INVENTION

A three-way catalyst removes the three noxious substances CO, HC and NOx from exhaust gas of an engine most effectively when the air oversupply ratio 1 lies within a predetermined range (known as the catalyst window) centered on $\lambda=1.0$. This air oversupply ratio 1 is directly related to the air-fuel ratio (hereinafter referred to as AFR) of the fuel mixture supplied to the engine and $\lambda=1.0$ is obtained when AFR is equal to the theoretical AFR. In one emission control system known in the art, therefore, an $O_2$ sensor detecting whether the oxygen content of the exhaust gas is more or less than the theoretical AFR equivalent is provided in the exhaust pipe of an engine, and AFR is controlled in the vicinity of the theoretical AFR by adjusting the fuel supply amount based on the feedback correction coefficient a which is determined from the $O_2$ sensor outputs.

This system works effectively as far as the engine comprises only one cylinder bank.

However, in engines having a plurality of cylinder banks such as V-type engines or horizontal opposed engines, the fuel mixture is distributed to each cylinder bank via an branched path, and the exhaust from each bank is collected via an branched path to the exhaust pipe and hence to the outside via the three-way catalyst.

In such an engine, if feedback correction of the AFR is performed based on an $O_2$ sensor provided near to the catalyst in the exhaust pipe, it is possible that there will still be some scatter of AFR between banks. In other words, even if the AFR detected by the sensor is in the vicinity of the theoretical AFR, there is still a possibility that the AFR of one bank is rich, while the AFR of another bank is lean. This kind of phenomenon occurs when, for example, the dimensions of the intake manifolds and fuel injection characteristics are different for different banks. Such scatter of AFR increases, however, the noxious substances in the exhaust gas.

In order to prevent scatter of AFR between banks, Tokkai Sho 62-63156 published by the Japanese Patent Office discloses an AFR controller wherein an $O_2$ sensor is provided for each bank, and the fuel supply amount is corrected independently for each bank such that the rich time of the AFR detected by these sensors is the same for two banks.

However, it is known that the conversion efficiency of the three-way catalyst actually decreases when the AFR for each bank is stable and the oxygen content of the exhaust gas around the catalyst does not deviate from the theoretical AFR equivalent. This is because the three-way catalyst has both oxidizing and reducing actions and both actions are more effective when the oxygen content of the exhaust gas fluctuates in the vicinity of the theoretical AFR equivalent. In other words, the conversion efficiency of the catalyst is higher when the AFR alternates between rich and lean.

SUMMARY OF THE INVENTION

It is therefore an object of this invention to control the oxygen content of the exhaust gas around the three-way catalyst of a multiple cylinder bank engine to vary with an appropriate amplitude about the theoretical AFR equivalent.

It is a further object of this invention to implement the aforesaid control using a small number of AFR sensors.

In order to achieve the above object, this invention provides an air-fuel ratio controller for an engine provided with a plurality of cylinder banks, an intake manifold provided for each cylinder bank to provide a fuel mixture to each cylinder in the bank, an exhaust manifold provided for each cylinder bank for collecting exhaust gas from each cylinder of the bank, an exhaust pipe combining the gas flow from each of the exhaust manifolds, and a three-way catalyst interposed in the exhaust pipe. The controller comprises an air-fuel ratio sensor installed in each of the exhaust manifolds, the sensor sensing an air-fuel ratio of the fuel mixture provided to the cylinder bank, a device for performing feedback control of the air-fuel ratio of all the cylinder banks based on the air-fuel ratio detected in a specific bank such that the air-fuel ratio of this specific bank varies within a predetermined amplitude about the theoretical air-fuel ratio as center value, a device for measuring a rich time during which the air-fuel ratio detected in a cylinder bank is greater than the theoretical air-fuel ratio and a lean time during which the air-fuel ratio detected in this cylinder bank is smaller than the theoretical air-fuel ratio, the measuring device being provided for each of the cylinder banks, and a device for correcting the feedback control for each cylinder bank such that the rich time and lean time measured by the measuring device are identical for any bank.

Alternatively, the controller may comprise an air-fuel ratio sensor installed in each of the exhaust manifolds, the sensor sensing an air-fuel ratio of the fuel mixture provided to the cylinder bank, means for performing feedback control of the air-fuel ratio of all the cylinder banks based on the air-fuel ratio detected in a specific bank such that the air-fuel ratio of the specific bank varies within a predetermined amplitude about the theoretical air-fuel ratio as center value, means for measuring a rich time during which the air-fuel ratio detected in a cylinder bank is greater than the theoretical air-fuel ratio and a lean time during which the air-fuel ratio detected in this cylinder bank is smaller than the theoretical air-fuel ratio, the measuring means being provided for each of the cylinder banks, means for computing a weighted average of proportions of the rich time and lean time measured in a plurality of air-fuel ratio varying cycles, the computation being based on a predetermined weighting coefficient, and means for correcting the feedback control for each cylinder bank such that the proportion of the rich time and the proportion of the lean time computed by the computing means are identical for any cylinder bank.

Preferably, the measurement device in any of the above controllers comprises a device which counts the number of engine revolutions in each rich and lean time.

The details as well as other features and advantages of this invention are set forth in the remainder of the specification and are shown in the accompanying drawings.

DESCRIPTION OF THE PREFERRED EMBODIMENTS

Figure 1:
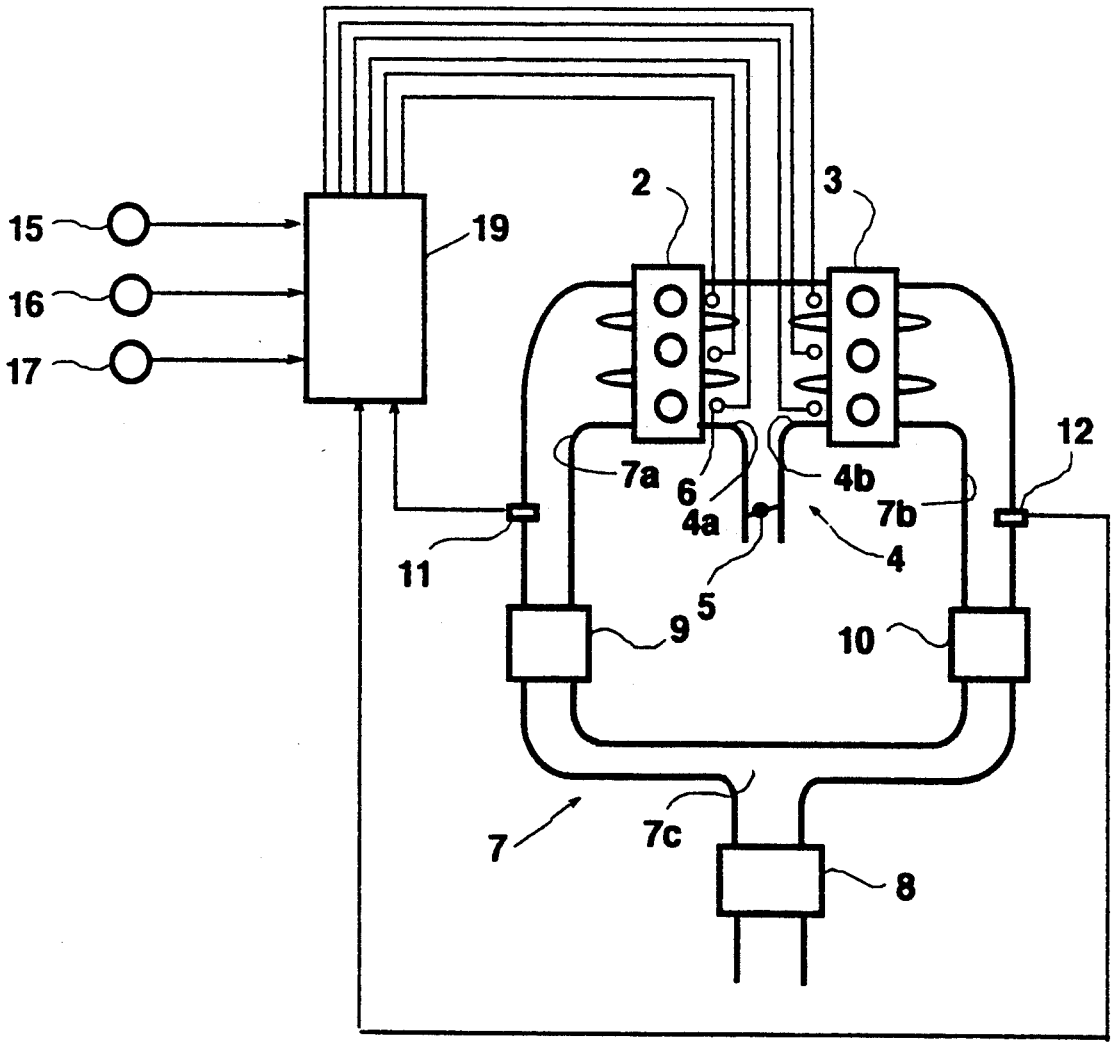
FIG. 1 is a schematic diagram of an AFR controller according to this invention.

Referring to FIG. 1 of the drawings, two banks (engine blocks) 2 and 3 each comprising a plurality of cylinders are disposed in a V-type engine in symmetrical positions with respect to each other. An intake pipe 4 is divided into intake manifolds 4*a*, 4*b* downstream of a throttle valve 5. The intake manifolds 4*a* and 4*b* are respectively connected to various cylinders arranged in the banks 2 and 3.

Air is taken into the engine via an air filter, not shown, and supplied to each cylinder of the banks 2 and 3 via the intake pipe 4, intake manifold 4*a* and intake manifold 4*b*. Fuel is injected into the air by an injector 6 provided in the intake port of each cylinder.

Exhaust gas manifolds 7*a*, 7*b* are also connected to the banks 2 and 3. The manifolds 7*a*, 7*b* combine together downstream in an exhaust gas pipe 7. A main catalyst 8 consisting of a three-way catalyst is provided downstream of a confluence 7*c* so as to oxidize CO, HC, and reduce NOx in the exhaust gas, and eliminate them. Pre-catalysts 9, 10 consisting of similar three-way catalysts are provided in the exhaust manifolds 7*a*, 7*b*.

$O_2$ sensors 11, 12 are provided as AFR sensors upstream of each pre-catalyst 9, 10 in the exhaust gas manifolds 7*a*, 7*b*, the output signals of these sensors being input to a controller 19 consisting of a microprocessor.

Signals are input to the controller 19 also from an airflow meter 15 for detecting the intake volume Qa of the intake pipe 5, a crank angle sensor 16 for detecting an engine rotation speed Ne and a reference position of the crank angle, and a water temperature sensor 17 for detecting the temperature of engine cooling water.

Based on these signals, the controller 19 performs feedback control of the fuel injection volume from the injector 6 according to the processes shown in FIGS. 2–6.

Figure 2:
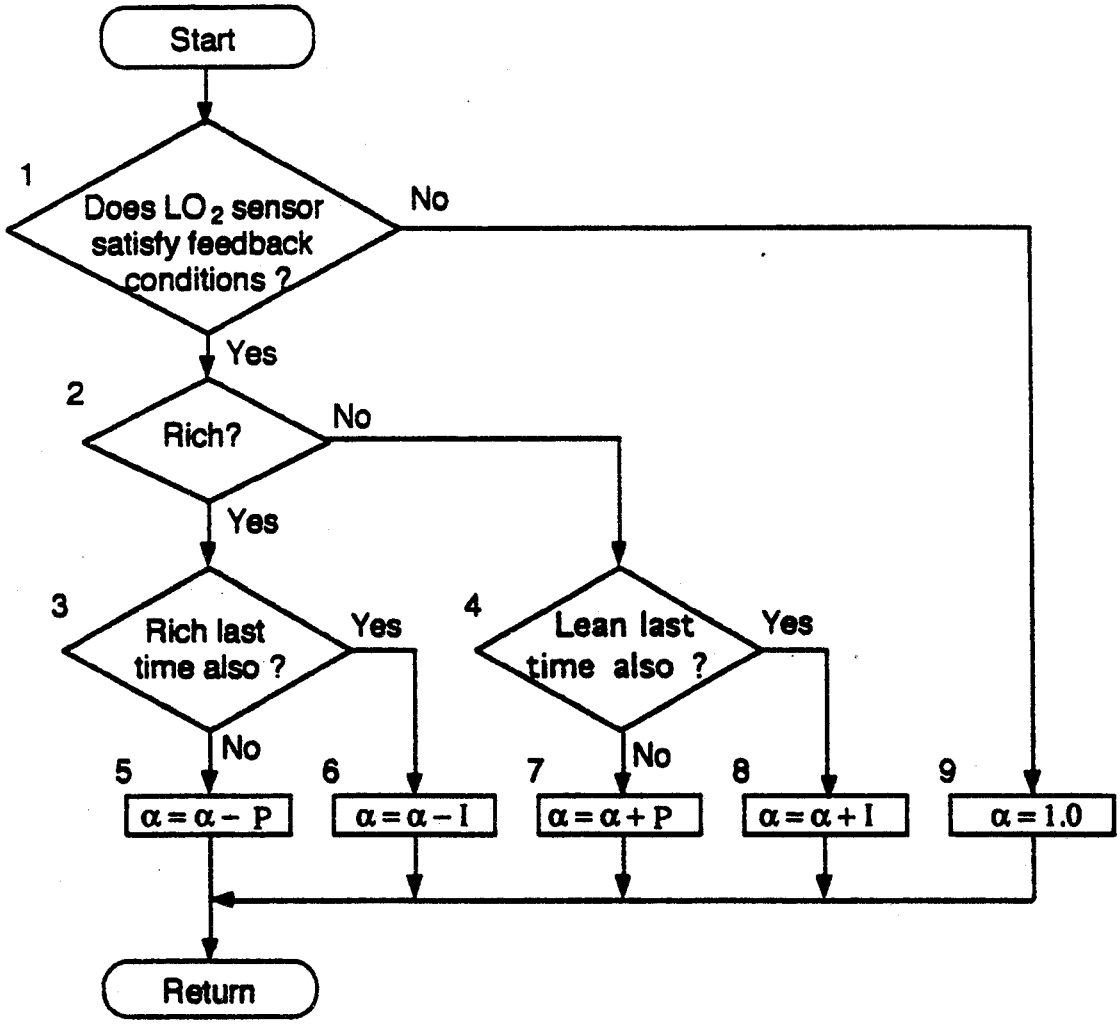
FIG. 2 is a flowchart illustrating the process of computing the AFR feedback correction coefficient $\alpha$ according to this invention.

FIG. 2 shows a basic routine for computing a common AFR feedback correction coefficient $\alpha$ of the banks 2 and 3. This routine is executed together with a fuel injection in synchronism with the engine speed. In a step 1, it is determined whether or not there is an abnormality in the $O_2$ sensor 11 for the left bank 2 (abbreviated in the figure as $LO_2$), and whether the AFR feedback correction conditions are satisfied. If so, the program proceeds to a step 2.

In steps 2–4, by comparing the output of the $O_2$ sensor 11 with a preset slice level, it is determined whether the AFR is changing from rich to lean or lean to rich, or whether rich or lean are continuing.

If the AFR is changing, the controller looks up a map of stored ID control differentials, and computes an AFR feedback control coefficient $\alpha$ using a calculated differential part P (step 5, step 7).

If on the other hand a rich or lean condition is continuing, the controller looks up a map of stored ID control integrals, and computes an AFR feedback control coefficient $\alpha$ from a calculated integral part I (step 6, step 8).

Thus, immediately after the AFR has changed from rich to lean, the AFR is rapidly restored to rich by adding a differential part P to $\alpha$, conversely immediately after the AFR has changed from lean to rich, the AFR is rapidly restored to lean by subtracting a differential part P from $\alpha$.

When a lean situation is continuing, the AFR is gradually restored to rich by adding an integral part I to $\alpha$, and when a rich situation is continuing, the AFR is gradually restored to lean by subtracting an integral part I from $\alpha$.

The map values of the aforesaid differential part P and integral part are pre-assigned with the basic injection pulse width Tp and engine speed Ne as parameters found from the engine load.

From the AFR feedback correction coefficient $\alpha$, the fuel injection pulse width Ti given to the injector 6 of the left bank 2 is computed from the known relation:

$$Ti_1 = Tp \times Co \times \alpha + Ts \quad (1)$$

where:

Tp = basic injection pulse width determined from Qa and Ne

Co = sum of unity and fuel increase correction coefficients

Ts = ineffectual pulse width depending on battery voltage

A fuel injection amount corresponding to this $Ti_1$ is then supplied from the injector 6 of the left bank 2 in synchronism with the engine speed.

Similarly, a fuel injection pulse width $Ti_2$ supplied to the injector 6 of the right bank 3 is computed from the relation:

$$Ti_2 = Tp \times Co \times \alpha \times KBANK2 + Ts \quad (2)$$

$Ti_2$ may also be obtained from the relation:

$$Ti_2 = Tp \times Co \times (\alpha + KBANK2 - 1) + Ts$$

where KBANK2 in Equation (2) is an AFR learning value.

Figure 3:
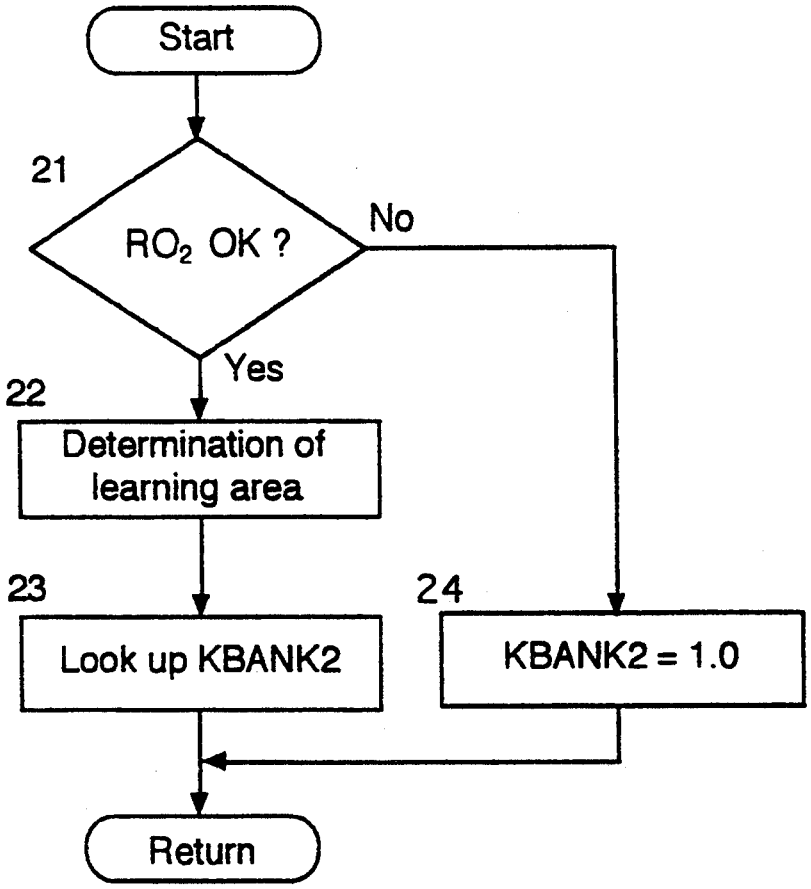
FIG. 3 is a flowchart illustrating the look-up process for an AFR learning value KBANK2 according to this invention.

The process for determining this learning value KBANK2 is shown in FIG. 3. Providing the $O_2$ sensor 12 of the right bank 3 (abbreviated as $RO_2$ in the figure) is not faulty (abbreviated as "OK" in the figure), the controller looks up the map in memory, and a learning value stored in a learning area corresponding to the current running conditions is read out (steps 21–24). In order to increase learning precision, the learning region is divided into a plurality of learning areas with the basic injection pulse width Tp and engine rotation speed Ne as parameters, and the learning value KBANK2 is stored for each learning area.

Figure 4:
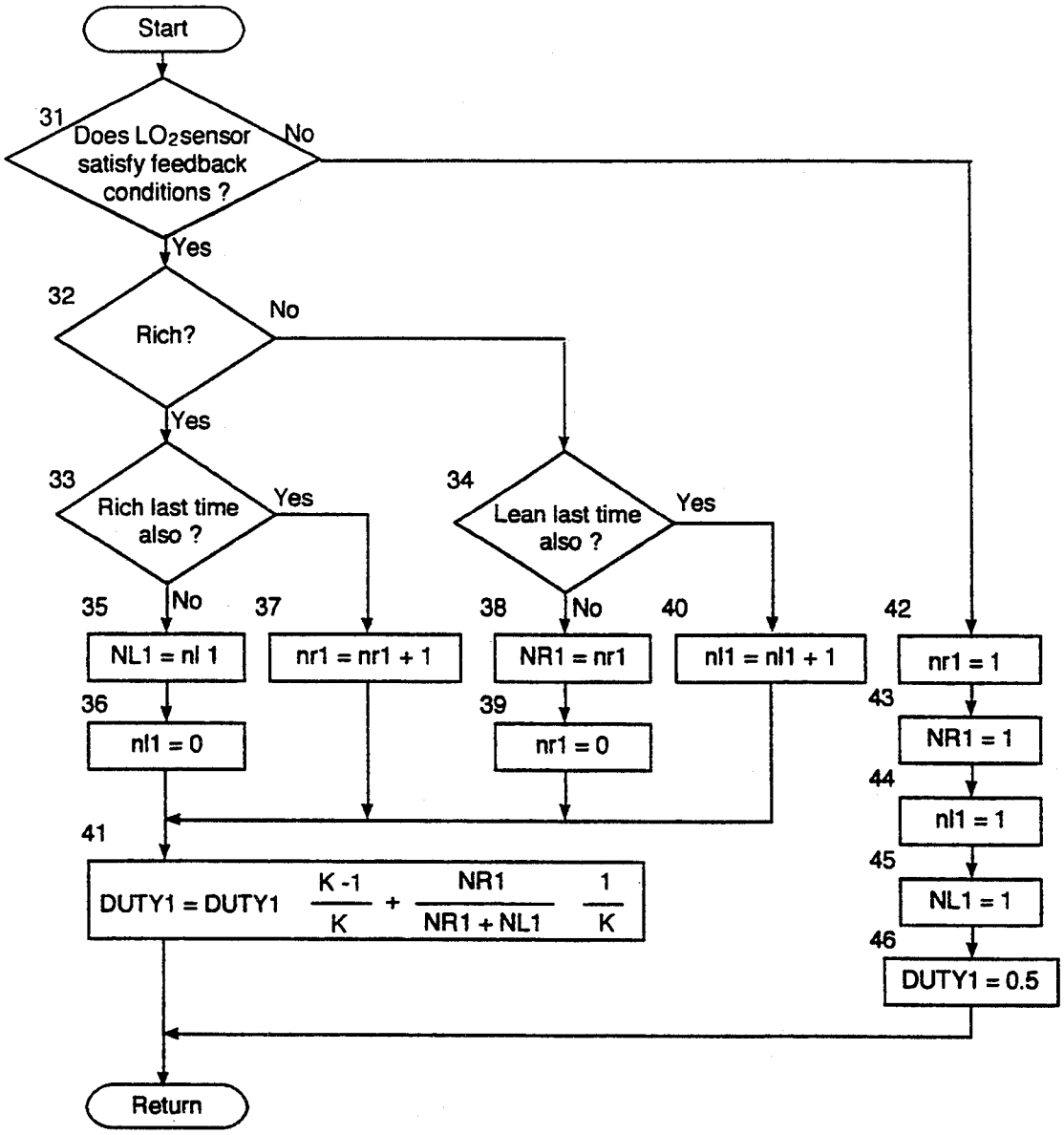
FIG. 4 is a flowchart illustrating the calculation process for a left bank rich proportion DUTY1 according to this invention.
Figure 5:
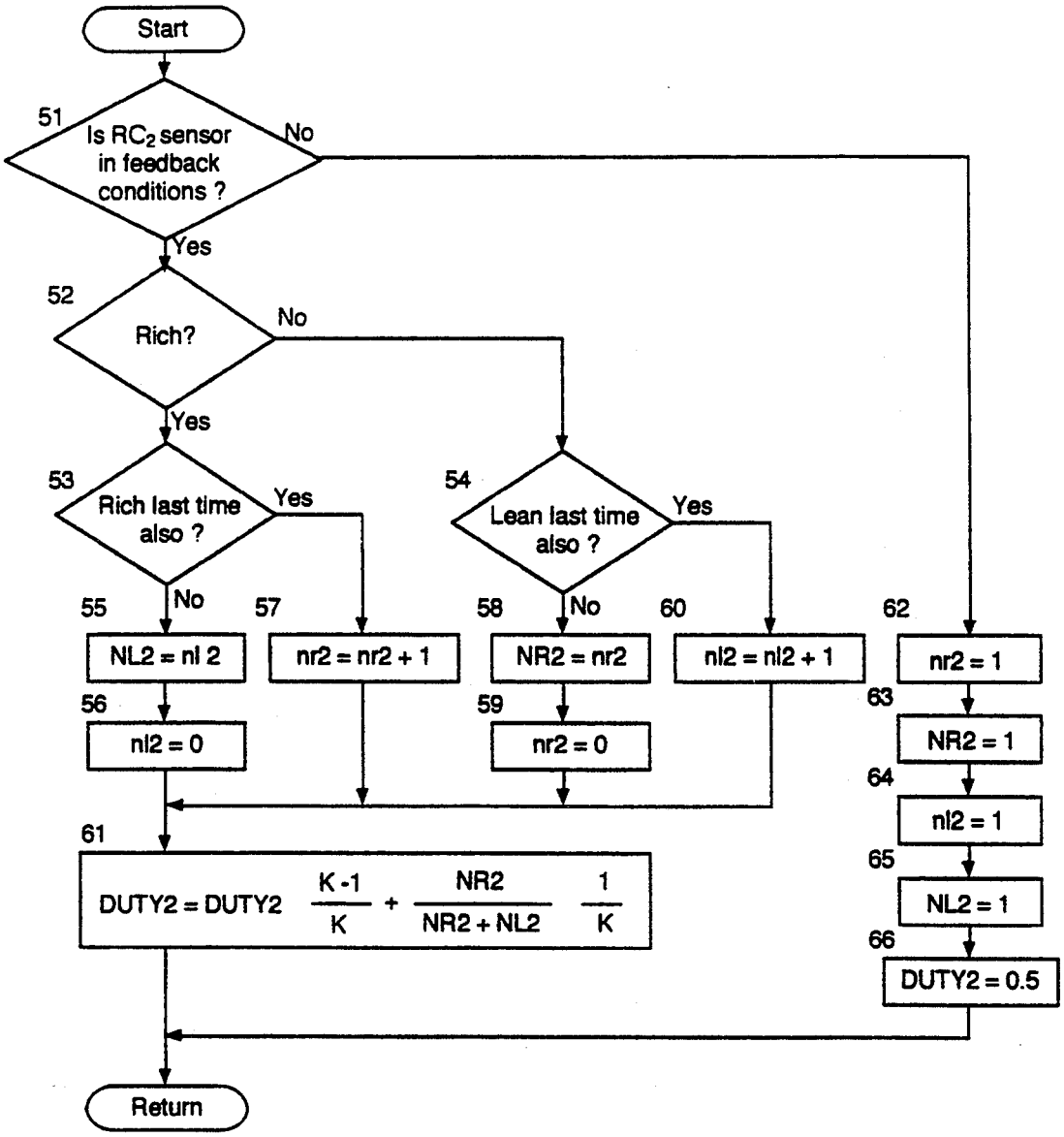
FIG. 5 is a flowchart illustrating the calculation process for a right bank rich proportion DUTY2 according to this invention.

FIG. 4 is a flowchart for the purpose of calculating the relation between the rich time and lean time of the left bank 2 from the output of the $O_2$ sensor 11, and FIG. 5 is a flowchart for the purpose of calculating the relation between the rich time and lean time of the right bank 3 from the output of the $O_2$ sensor 12. As the calculation process is the same in both cases, the flowchart of FIG. 4 will be described herein. These calculations are performed with the same period as the basic routine of FIG. 2 in synchronism with the engine rotation.

If the feedback conditions are satisfied, it is first judged whether or not rich conditions are continuing (steps 32, 33), and if so, the count value nr1 is increased by 1 at a time (step 37).

If there was a change from rich to lean in steps 32 and 34, the count value nr1 is transferred to a memory NR1 (step 38). The number of times the engine has rotated when the AFR is rich is thereby stored in NR1. After nr1 is transferred to NR1, nr1 is cleared (step 39).

Similarly, if lean conditions continue, a count value nl1 is increased by 1 at a time (steps 32, 34, 40). Further, immediately after there has been a change from lean to rich, the count value nl1 is transferred to a memory NL1 (steps 32, 33, 35, 36). The number of times the engine has rotated when the AFR is lean is thereby stored in NL1.

From NR1 and NL1 found as described hereintofore, a rich proportion, which is a value expressing the relation between the rich time and lean time, may be found from the relation:

$$\text{Rich proportion of left bank} = NR1/(NR1+NL1) \quad (3)$$

Instead of equation (3), any of the relations:

Rich proportion of left bank=NR1/NL1

Rich proportion of left bank=NR1−NL1

Lean proportion of left bank=NL1/(NR1+NL1)

Lean proportion of left bank=NL1/NR1

Lean proportion of left bank=NL1−NR1 may be used. NR1 and NL1 are rotation speeds, but if AFR control is to be performed not on the basis of rotation synchronism but on the basis of time synchronism, NR1 and NL1 may be respectively rich time and lean time.

Next, a weighted average value DUTY1 of the rich proportion from Equation (3), is found from:

$$\text{DUTY1} = \text{DUTY1} \times (K-1)/K + (\text{Rich proportion of left bank}) \times (1/K) \quad (4)$$

(step 41).

In Equation (4), (K−1)/K and 1/K are weightings

As scattering tends to occur in the value of the rich proportion found in Equation (3), a weighted average is taken to eliminate the effect of this scattering. The value of K is determined experimentally.

Also, if we write 1/K=w, Equation (4) becomes:

$$\text{DUTY1} = \text{DUTY1} \times (1-w) + (\text{Rich proportion of left bank}) \times w$$

which may be used instead of the original equation (4).

A simple average over a predetermined number of times may also be used instead of a weighted average.

Similarly, according to the flowchart of FIG. 5, the relation:

$$\text{Rich proportion of right bank} = NR2/(NR2+NL2) \quad (5)$$

may be found from the output of the right bank $O_2$ sensor 12. From this relation, a weighted average value DUTY2 is found from:

$$\text{DUTY2} = \text{DUTY2} \times (K-1)/K + (\text{Rich proportion of right bank}) \times (1/K) \quad (6)$$

(step 61).

Figure 6:
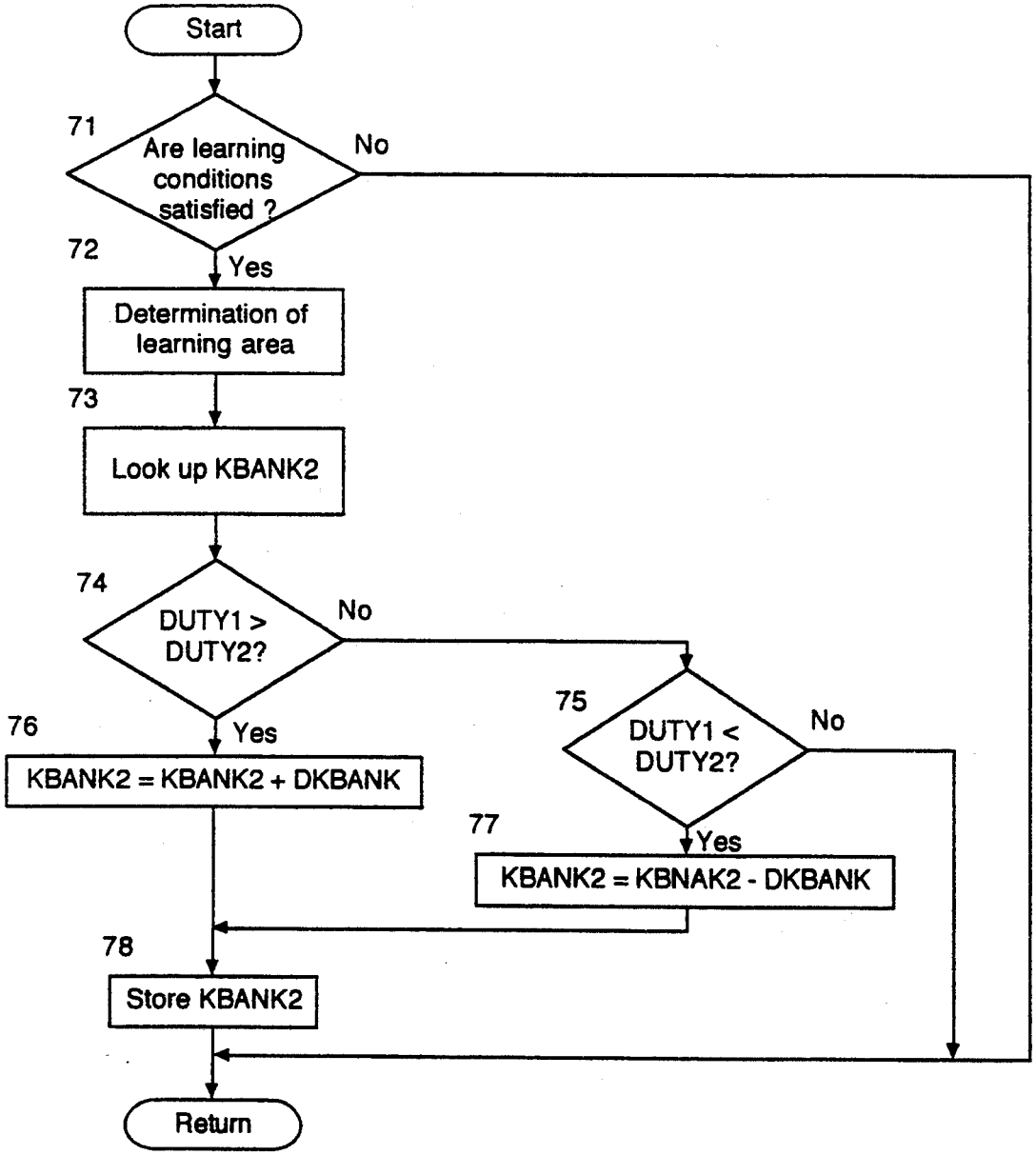
FIG. 6 is a flowchart illustrating the updating process for an AFR learning value KBANK2 according to this invention.

FIG. 6 is a flowchart for updating the AFR learning value KBANK2 which is executed after calculating DUTY1 and DUTY2. This routine is also performed with rotation synchronism, but it may be synchronized with steps 5 and 7 of FIG. 2, steps 35 and 38 of FIG. 4, or steps 55 and 58 of FIG. 5.

First, in a step 71, it is judged whether or not the learning conditions are satisfied. If for example the $O_2$ sensor 12 of the left bank 3 is not active, or if the running conditions do not remain in the same learning area for a certain number of times, learning is prohibited.

If the learning conditions are satisfied, the learning value KBANK2 stored in the learning area corresponding to the present running conditions is looked up, and stored in a resistor of the CPU (steps 72, 73).

In steps 74 and 75, the two weighted averages DUTY1 and DUTY2 are compared. For example, if the AFR of the left bank 2 is controlled to within the catalyst window by feedback control, DUTY1 should be 50%, and if DUTY1>DUTY2 is satisfied, it is judged that rich time should be shorter than lean time in the right bank 3—i.e., the right bank 3 tends toward the lean side.

If it is judged that the right bank 3 tends toward the lean side as described hereintofore, the learning value is updated by increasing the learning value KBANK2 by a constant value DKBANK, and the updated value is stored in the same learning area (steps 74, 76, 78). By increasing the learning value KBANK2, the amount of fuel supplied to the right bank 3 is increased, and the AFR of the right bank 3 is shifted towards the rich side.

If on the other hand, it is judged that the AFR of the right bank is on the rich side, the amount of fuel supplied is decreased by decreasing the learning value KBANK2 by the constant value DKBANK, and the AFR of the right bank 3 is shifted toward the lean side (steps 74, 75, 77, 78).

This updating of the learning value KBANK2 is repeated until DUTY1=DUTY2. The initial value of the learning value KBANK2 is 1.

The operation of this control system will now be described with reference to FIG. 8.

By means of this feedback control, insofar as concerns the output of the $O_2$ sensor 11 of the left bank 2, the rich time and lean time effectively become the same as shown by the figure.

Figure 7:
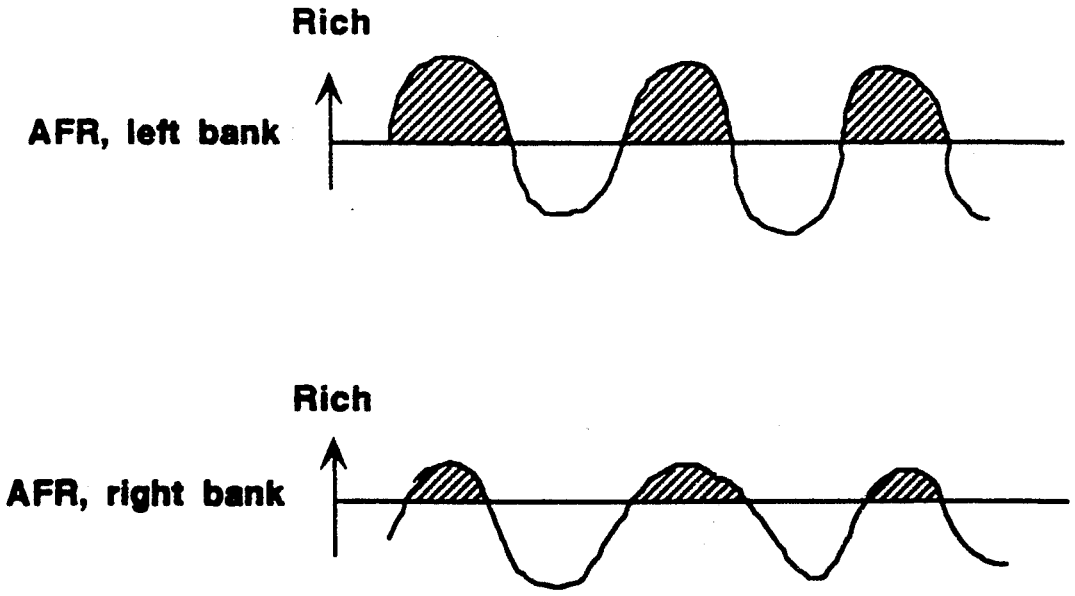
FIG. 7 is a waveform illustrating the scatter in the AFR between the left and right banks.

If however, due to time-dependent variation of the injector, fuel flow becomes narrowed in for example the injector of the right bank 3, the AFR of the right bank 3 moves outside the catalyst window and tends toward the lean side as shown by FIG. 7. If exhaust gas produced when the AFR is on the lean side is mixed in the confluence 7c, the AFR detected from the exhaust gas after combination of flows may also lie outside the catalyst window.

Figure 8:
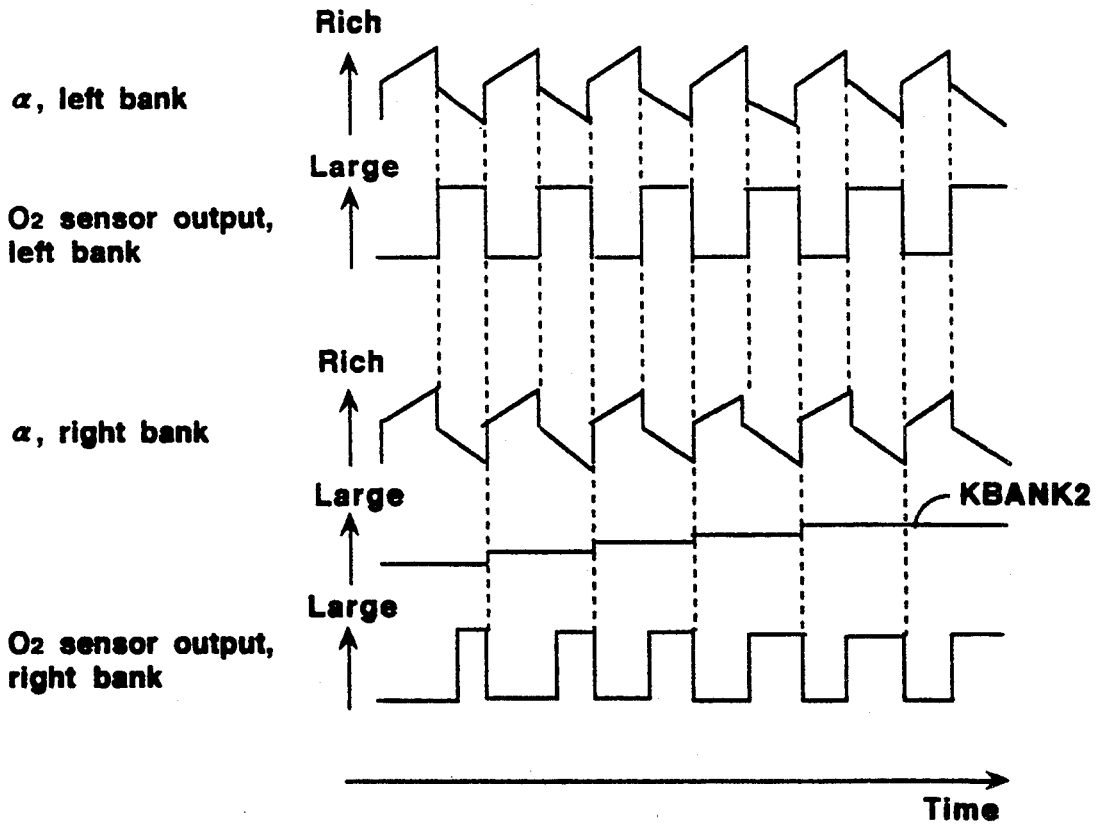
FIG. 8 is a waveform showing the variation of AFR in the control system according to this invention.

In such a case, if it is judged from the relation DUTY1>DUTY2 that the AFR of the right bank 3 has tended toward the lean side, the learning value KBANK2 is updated in the direction of increase as shown by FIG. 8, and the amount of fuel supplied to the right bank 3 is increased until DUTY1=DUTY2. If DUTY1=DUTY2, DUTY2 is also 50% (i.e. the rich time and lean time in the right bank 3 are the same), and the AFR of the right bank 3 will also lie within the catalyst window.

If on the other hand the AFR of the right bank 3 has tended toward the rich side, the learning value KBANK2 is updated so as to make it smaller, and the amount of fuel supplied to the right bank 3 is decreased so as to bring the AFR variation of the right bank 3 within the catalyst window.

In this way, the AFR variations of both the banks 2 and 3 are brought within the catalyst window, and the AFR variation of the exhaust gas flowing downstream of the confluence 7c is also brought within the catalyst window.

Also, as the phase of $\alpha$ is the same for both the left and right banks 2 and 3 as shown in FIG. 8, the AFR detected downstream of the confluence 7c is never constant. When the amount of fuel supplied to the left bank 2 is for example increased stepwise by a differential part P, the amount of fuel supplied to the right bank 3 is also increased by a differential part P having the same value. As the fuel amount is increased to both banks 2 and 3 with the same phase, the AFR variation of the exhaust gas flowing through the main catalyst 8 may be amplified, but it cannot be attenuated. The AFR therefore fluctuates with a predetermined amplitude about the theoretical AFR as center value.

Thus, not only is scatter of AFR between banks suppressed as in the prior art, but the conversion efficiency of the catalyst is maintained at a high level by causing the AFR of the exhaust gas led to the main catalyst 8 to vary with a predetermined amplitude.

Further, only two $O_2$ sensors are installed, so the number of $O_2$ sensors can be reduced compared to the number required by conventional controllers.

According to this invention, AFR feedback control is performed based on the $O_2$ sensor 11 of the left bank 2, hence feedback control is more rapid compared to the conventional case wherein the control is based on an $O_2$ sensor installed downstream of the confluence of the exhaust manifolds. From a control viewpoint, there is a response delay from when the gas is burnt in the engine to when it reaches the $O_2$ sensor, so by installing the sensor upstream, this response delay is shortened.

Also, by using a weighted average or simple average of the rich proportion, the effect of scatter in each calculation of the rich proportion is reduced. The precision of detecting the AFR, and consequently learning precision, are thereby improved.

This invention is not limited to the aforesaid examples, and various design modifications are possible. The invention is for example not restricted to V-type engines or horizontal opposed engines, and may be applied also to six cylinder engines by dividing the intake and fuel supply into two banks of three cylinders.

There may be no more than one AFR learning value KBANK2 in the whole learning area, or alternatively it may be introduced simply as a correction value rather than a learning value. It is of course understood however that AFR characteristics immediately after engine start-up are improved if it is a learning value.

Instead of an $O_2$ sensor which detects only whether the air-fuel composition is rich or lean with respect to the theoretical AFR, a sensor which detects the actual value of the AFR from lean to rich, i.e. a wide range AFR sensor, may also be used.

The embodiments of this invention in which an exclusive property or privilege is claimed are defined as follows:

I claim:

1. An air-fuel ratio controller for an engine provided with a plurality of cylinder banks, an intake manifold provided for each cylinder bank to provide a fuel mixture to each cylinder in the bank, an exhaust manifold provided for each cylinder bank for collecting exhaust gas from each cylinder of the bank, an exhaust pipe combining the gas flow from each of said exhaust manifolds, and a three-way catalyst interposed in said exhaust pipe, said controller comprising;

an air-fuel ratio sensor installed in each of said exhaust manifolds, said sensor sensing an air-fuel ratio of the fuel mixture provided to the cylinder bank, means for performing feedback control of the air-fuel ratio of all the cylinder banks based on the air-fuel ratio detected in a specific bank such that the air-fuel ratio of said specific bank varies within a predetermined amplitude about the theoretical air-fuel ratio as center value, means for measuring a rich time during which the air-fuel ratio detected in a cylinder bank is greater than the theoretical air-fuel ratio and a lean time during which the air-fuel ratio detected in this cylinder bank is smaller than the theoretical air-fuel ratio, said measuring means being provided for each of the cylinder banks, and means for correcting said feedback control for each cylinder bank such that the rich time and lean time measured by said measuring means are identical for any bank.

2. An AFR controller as defined in claim 1 wherein said measurement means comprises a device which counts the number of engine revolutions in each rich and lean time.

3. An air-fuel ratio controller for an engine provided with a plurality of cylinder banks, an intake manifold provided for each cylinder bank to provide a fuel mixture to each cylinder in the bank, an exhaust manifold provided for each cylinder bank for collecting exhaust gas from each cylinder of the bank, an exhaust pipe combining the gas flow from each of said exhaust manifolds, and a three-way catalyst interposed in said exhaust pipe, said controller comprising;

an air-fuel ratio sensor installed in each of said exhaust manifolds, said sensor sensing an air-fuel ratio of the fuel mixture provided to the cylinder bank, means for performing feedback control of the air-fuel ratio of all the cylinder banks based on the air-fuel ratio detected in a specific bank such that the air-fuel ratio of said specific bank varies within a predetermined amplitude about the theoretical air-fuel ratio as center value, means for measuring a rich time during which the air-fuel ratio detected in a cylinder bank is greater than the theoretical air-fuel ratio and a lean time during which the air-fuel ratio detected in this cylinder bank is smaller than the theoretical air-fuel ratio, said measuring means being provided for each of cylinder banks, means for computing a weighted average of proportions of the rich time and lean time measured in a plurality of air-fuel ratio varying cycles, said computation being based on a predetermined weighting coefficient, and means for correcting said feedback control for each cylinder bank such that the proportion of the rich time and the proportion of the lean time computed by said computing means are identical for any cylinder bank.

4. An AFR controller as defined in claim 3 wherein said measurement means comprises a device which counts the number of engine revolutions in each rich and lean time.

* * * * *